US005184728A

United States Patent [19]

Wile

[11] Patent Number: 5,184,728

[45] Date of Patent: Feb. 9, 1993

[54] BAG DISPENSING SYSTEM

[75] Inventor: Richard M. Wile, Medfield, Mass.

[73] Assignee: BPI Environmental, Inc., Taunton, Mass.

[21] Appl. No.: 811,692

[22] Filed: Dec. 20, 1991

[51] Int. Cl.[5] ..... B65D 73/00

[52] U.S. Cl. ..... 206/554; 206/493; 206/806

[58] Field of Search ..... 206/493, 495, 554, 806; 220/404; 383/37

[56] References Cited

U.S. PATENT DOCUMENTS

| | | | |
|---|---|---|---|
| 1,683,641 | 9/1928 | Whitney | 206/806 |
| 2,604,253 | 7/1952 | Turner | 206/493 |
| 2,967,611 | 1/1961 | Bolinger | 206/806 |
| 3,285,406 | 11/1966 | Winesett | 206/493 |
| 3,285,407 | 11/1966 | Abramson | 206/493 |
| 3,318,444 | 5/1967 | Weicher et al. | 206/493 |
| 3,406,818 | 10/1968 | Barnett | 206/493 |
| 3,417,864 | 12/1968 | Paxton | 206/493 |
| 3,896,932 | 7/1975 | Giebel et al. | 206/493 |
| 4,062,170 | 12/1977 | Orem . | |
| 4,199,122 | 4/1980 | Christie . | |
| 4,480,750 | 11/1984 | Dancy . | |
| 4,487,388 | 12/1984 | Provan . | |
| 4,493,419 | 1/1985 | Prader et al. . | |
| 4,527,693 | 7/1985 | Membrino | 206/554 |
| 4,676,378 | 6/1987 | Baxley et al. . | |
| 4,877,473 | 10/1989 | Snowdon et al. . | |

FOREIGN PATENT DOCUMENTS

| | | | |
|---|---|---|---|
| 753128 | 2/1967 | Canada | 206/806 |
| 677797 | 8/1952 | United Kingdom | 206/554 |
| 2234734 | 2/1991 | United Kingdom | 206/554 |

*Primary Examiner*—David T. Fidei
*Attorney, Agent, or Firm*—Henry D. Pahl, Jr.

[57] ABSTRACT

In the bag pack disclosed herein, a stack of T-shirt type plastic film bags are held in a paperboard cartridge which is folded to provide front and back panels bridged at the top. The back panel has a cutout tongue which is folded forward under tearaway strips linking the top ends of the bag handle portions. The tongue retains the tearaway strips in the cartridge as individual bags are torn downwardly from the pack.

9 Claims, 2 Drawing Sheets

BAG DISPENSING SYSTEM

BACKGROUND OF THE INVENTION

The present invention relates to a bag pack and more particularly to a cartridge for holding a stack of T-shirt type plastic film bags suitable for enclosing produce and the like.

As is understood by household shoppers generally as well as by those skilled in the art, produce in supermarkets is normally displayed in open bins or chill cases so that each shopper can select the individual items according to his or her preferences. It is customary to provide a supply of bags or sacks for packaging the produce so that it can easily be carried to a checkout counter. The most usual arrangement for dispensing the bags is to have them wound on a roll which is then hung so that individual bags can be drawn down and torn from the roll. This is not an entirely satisfactory arrangement in most instances since the roll will often overrun instead of releasing an individual bag. The use of both hands may be required to separate an individual bag from the roll. Further, the bags dispensed are typically simple tubes open at one end which may require a wire tie or the like for satisfactory closing. Similar problems exist in bakery and delicatessen contexts. The present invention provides an effective solution to these various problems and also yields a bag pack and dispenser construction which is advantageously useful in a variety of environments including convenience stores and supermarkets as well as produce, bakery and delicatessen contexts.

In accordance with one aspect of the present invention, it has been recognized that T-shirt type plastic film bags constitute a much improved mechanism for packaging produce since the loop handles extending upward on either side of the mouth of the bag can be tied to retain the contents. In accordance with another aspect of the invention, there is provided a novel cartridge and dispensing system for providing easy access to individual bags in a pack.

Among the several objects of the present invention may be noted the provision of a novel bag pack; the provision of such a bag pack which facilitates dispensing of individual bags from the pack; the provision of such a bag pack which incorporates a cartridge for retaining a stack of T-shirt type plastic film bags; the provision of a dispensing system for plastic film bags which is easily loaded; the provision of such dispensing system which does not create clutter; the provision of such a bag dispensing system which is of attractive appearance and which is easily operated; the provision of such a bag pack and dispensing system which are highly reliable and which are of relatively simple and inexpensive construction. Other objects and features will be in part apparent and in part pointed out hereinafter.

SUMMARY OF THE INVENTION

The dispensing system of the present invention employs a cartridge for holding a stack of T-shirt type plastic film bags having loop handles extending upwardly on either side of the mouth of the bag with the handles being linked at their upper ends by a tearaway strip extending between them. The cartridge is constructed of a stiff web member such as corrugated boxboard which is folded to provide front and back parallel panels bridged at their upper ends by a top panel. The handle portions of the bags extend upwardly between the front and back panels. The back panel has a cutout tongue which is folded forward under the tearaway strips to retain them as individual bags are torn downwardly from the pack. This tongue extends through an aperture in the front panel for support.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
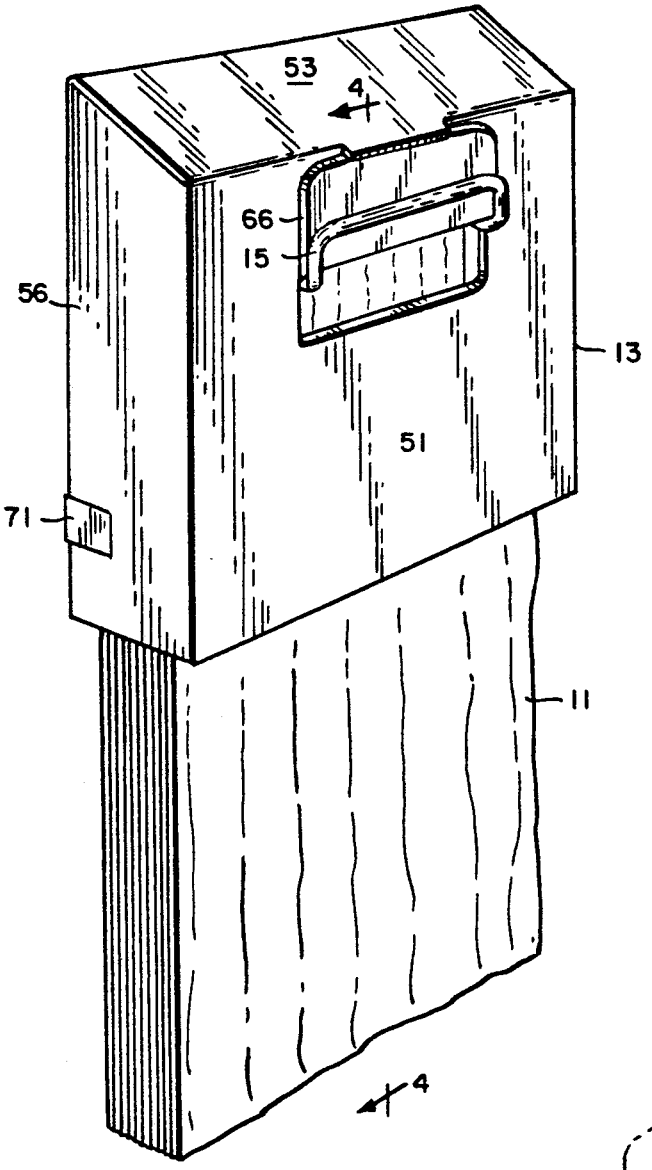
FIG. 1 is a perspective view of a produce bag dispensing system in accordance with the present invention.
Figure 5:
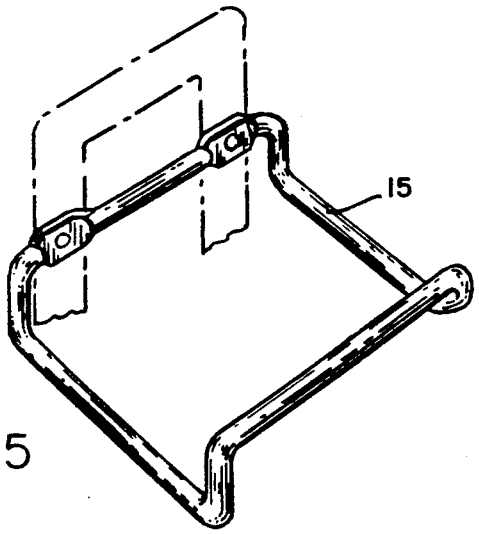
FIG. 5 is a perspective view of a bent wire hook employed in holding the cartridge and bag pack of FIGS. 1 and 4.
Figure 2:
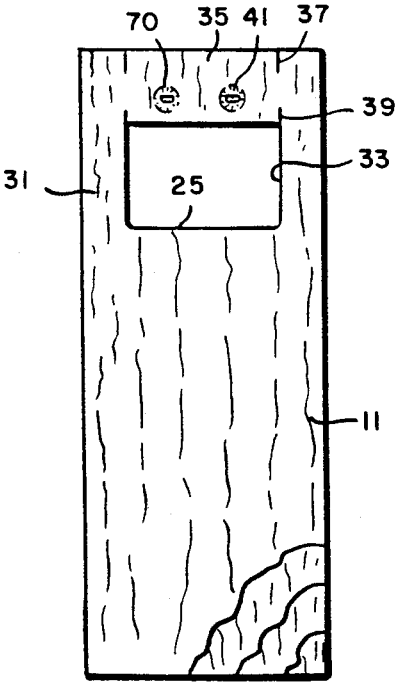
FIG. 2 is a face view of a pack of T-shirt type plastic film bags which can be dispensed using the system of FIG. 1.
Figure 4:
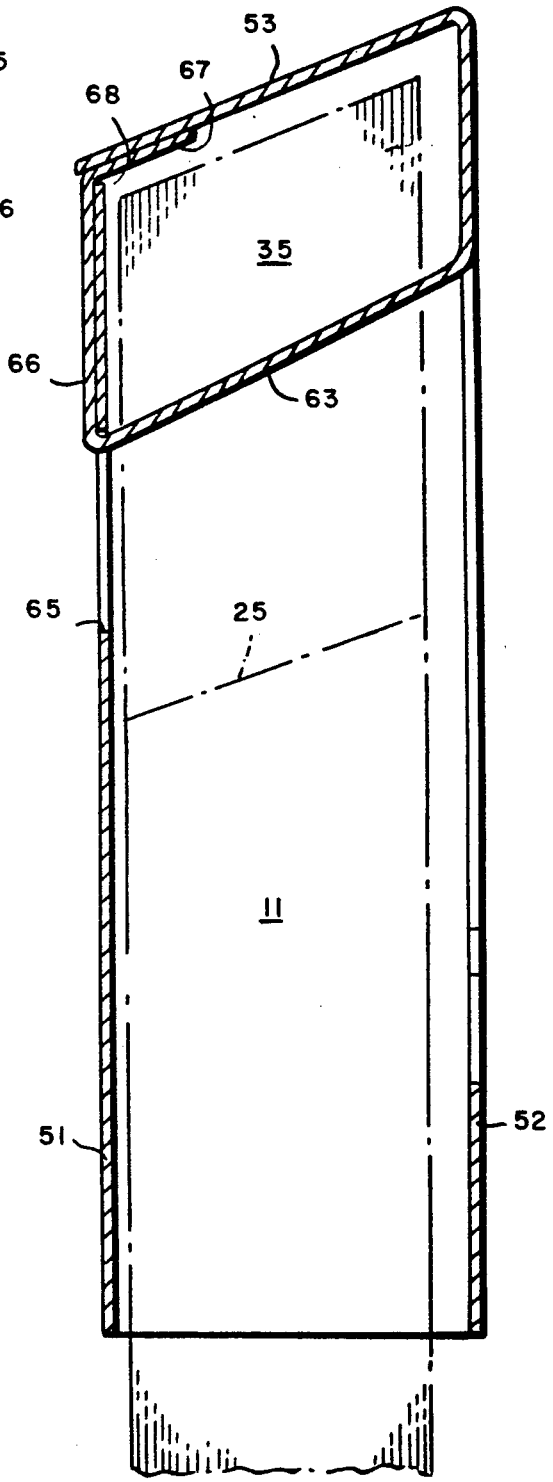
FIG. 4 is a cross-sectional view through the cartridge and bag pack employed in the dispensing system of FIG. 1.

Referring now to FIG. 1, a stack of T-shirt type plastic film bags 11 are held for dispensing in a folding boxboard cartridge 13 which is, in turn, mounted on a bent wire hook 15. As indicated, the bags 11 are generally of the T-shirt type and have an outline form as illustrated in FIG. 2.

The bags 11 are preferably formed from a gussetted tube of a suitable plastic film which is heat sealed at intervals to close off the tube at each end of the bag. A preferred form of plastic film material is that disclosed in copending, coassigned application Ser. No. 07/677,534 filed on Mar. 29, 1991 by Dennis N. Caulfield, Eric George and Alex Vaicunas and entitled Polymeric Material And Clear Film Produced Therefrom. The method of forming the bags themselves is also described in greater detail in said copending application Ser. No. 07/677,534 and the disclosure of that application is incorporated herein by reference.

After the heat seals are made, the individual bag blanks are separated and stacked. A central cutout, indicated by reference character 25, is then made and creates an openable bag mouth and leaves handle portions, 31 and 33 respectively, on either side of the mouth. In accordance with one aspect of the present invention, a tearaway strip 35 is left between the handle portions 31 and 33, the strip being partially cut through at each end as indicated by reference characters 37 and 39 so that the bags can easily be torn away from the central strip during dispensing. The central strips 35 in a stack of bags are preferably bonded together, e.g. by hot pins, so as to form the bags into a pack of a convenient number, typically fifty. In FIG. 2, the bonding points are indicated by reference characters 40 and 41.

Figure 3:
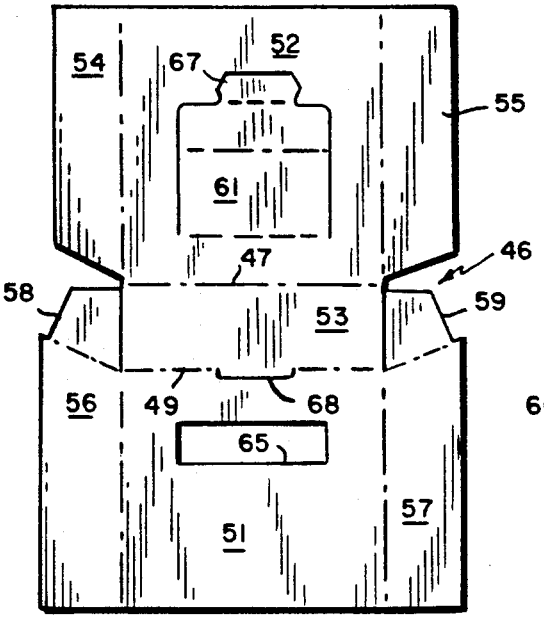
FIG. 3 is an outline view of an unfolded boxboard cartridge employed in the system of FIG. 1.

The cartridge 13 is formed from a corrugated boxboard blank 46 having an outline as shown in FIG. 3. The blank 46 is folded along lines 47 and 49 to provide a front panel 51 which overlies the handle portions of a stack of bags and a parallel back panel 52, the front and back panels being joined by a top panel 53. Side panels 54 and 55 are folded forward from the back panel 52 and overlying side panels 56 and 57 are folded back from the front panel 51. The sides 56 and 57 extending from the front panel include tabs 58 and 59 which are folded under the top panel 53.

A large depending tongue portion 61 is cut out from the back panel 52 and is folded so that a portion 63 extends forward under the tearaway strips 35 of a bag pack contained in the cartridge. The tongue portion 63 extends through a rectangular opening 65 in the front panel 51 and a further portion 66 is folded up parallel to the upper portion of the front panel 51 and terminates in a tab portion 67 and extends through a slot 68 cut at the juncture between the front panel 51 and the top panel 53. When the blank 46 is folded as described, it will largely hold itself in assembled position but it is preferably secured by tape strips as indicated at 71 in FIG. 1.

As indicated, the cartridge 13 may be assembled with one or more stacks or packs of the bags 11 held therein, the tearaway strips being retained by the tongue portion 63. In use, the cartridge with contained bag stacks is hung on a wire hook 15 or similar fixture with the hook extending through the cutout for the tongue portion in the rear panel and the rectangular aperture 65 in the front panel 51 with the bags 11 hanging down from the tearaway strips.

A produce customer desiring to obtain a bag merely grasps the front one and pulls down so that the handle portions 31 and 33 separate from the tearaway strip 35. This can typically be accomplished with one hand. The tearaway strips 35 are retained in the cartridge and do not form litter in the produce area. When all of the bags have been utilized, the fixture is easily re-loaded by removing the exhausted cartridge and replacing it with a full one. Not only does the dispensing system of the present invention provide easy dispensing of a very functional bag, but it is easily serviced and presents a very neat appearance in the supermarket area which it is intended to serve.

In view of the foregoing it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. A cartridge for holding a stack of plastic film bags of the type having loop handles extending upwards on either side of the mouth of the bag, the handles being linked at their upper ends by a tearaway strip extending between them, said cartridge comprising:

a stiff web member which is folded to provide front and back parallel panels bridged at their upper ends by a top panel, the handle portions of said bags extending upwards between said front and back panels, said back panel having a cutout tongue which is folded forward under said tearaway strips to retain them as individual bags are torn downwardly from the pack and which passes through an aperture in said front panel and, after passing through said aperture, extends upwardly parallel to said front panel and terminates in a tab extending through a slot in said front panel.

2. A bag pack comprising:

a stack of plastic film bags of the type having a mouth and loop handles extending upwards on either side of the mouth, the handles being linked at their upper ends by a tearaway strip extending between them;

a stiff web member which is folded to provide front and back parallel panels bridged at their upper ends by a top panel, the mouth portions of the bags being contained between said front and back panels with the handle portions of said bags extending upwardly to said top panel, said back panel having a cutout tongue which is folded forward under said tearaway strips to retain them as individual bags are torn downwardly from the pack and which passes through an aperture in said front panel.

3. A bag pack as set forth in claim 2 wherein said web member provides side panels extending between said front and back panels.

4. A bag pack as set forth in claim 2 wherein said tongue member, after passing through said aperture, extends upwardly parallel to said front panel and terminates in a tab extending through a slot in said front panel.

5. A bag pack as set forth in claim 2 wherein the tearaway strips in the stack of bags are bonded to each other.

6. A bag dispensing system comprising:

a stack of plastic film bags of the type having loop handles extending upwards on either side of the mouth of the bag, the handles being linked at their upper ends by a tearaway strip extending between them;

a cartridge retaining said stack, which cartridge is formed of a stiff web member which is folded to provide front and back parallel panels bridged at their upper ends by a top panel, the handle portions of said bags extending upwards between said front and back panels, said back panel having a cutout providing a tongue which is folded forward under said tearaway strips to retain them as individual bags are torn downwardly from the pack and which passes through an aperture in said front panel and, after passing through said aperture, extends upwardly parallel to said front panel and terminates in a tab extending through a slot in said front panel;

a hook member which extends forward through said cutout in said back panel, under said tongue, through said aperture, and then upwardly for holding said cartridge and stack of bags.

7. A bag dispensing system as set forth in claim 6 wherein said web member provides side panels extending between said front and back panels.

8. A bag dispensing system as set forth in claim 6 wherein the tearaway strips in the stack of bags are bonded to each other.

9. A bag dispensing system comprising:

a stack of plastic film bags of the type having loop handles extending upwards on either side of the mouth of the bag;

a cartridge retaining said stack, which cartridge is formed of a stiff web member which is folded to provide front and back parallel panels bridged at their upper ends by a top panel, the handle portions of said bags extending upwards between said front and back panels, said back panel having a cutout providing a tongue which is folded forward and passes through an aperture in said front panel; and a hook member which extends forward through said cutout in said back panel, under said tongue, through said aperture, and then upwardly for holding said cartridge and stack of bags.

* * * * *